US008424982B1

(12) United States Patent
Schwartz

(10) Patent No.: US 8,424,982 B1
(45) Date of Patent: Apr. 23, 2013

(54) MEDICINE/COSMETIC CABINET SYSTEM

(76) Inventor: Ilene R. Schwartz, Brandon, FL (US)

( * ) Notice: Subject to any disclaimer, the term of this patent is extended or adjusted under 35 U.S.C. 154(b) by 0 days.

(21) Appl. No.: 13/370,684

(22) Filed: Feb. 10, 2012

Related U.S. Application Data

(63) Continuation-in-part of application No. 12/462,771, filed on Aug. 10, 2009, now abandoned.

(51) Int. Cl.
*A47B 67/02* (2006.01)

(52) U.S. Cl.
USPC ..... 312/227; 312/245; 312/242

(58) Field of Classification Search ..... 312/292, 312/298, 326, 329, 351, 242, 209, 224, 225, 312/226, 227, 245
See application file for complete search history.

(56) References Cited

U.S. PATENT DOCUMENTS

| | | | | | |
|---|---|---|---|---|---|
| 1,581,776 | A * | 4/1926 | Altschul | 211/4 |
| 1,877,514 | A * | 9/1932 | Katzman | 312/227 |
| 2,070,641 | A * | 2/1937 | Bartels | 312/224 |
| 2,166,430 | A * | 7/1939 | Green | 49/70 |
| 2,752,217 | A * | 6/1956 | Simon | 312/242 |
| 3,109,685 | A * | 11/1963 | Paul Skorupa | 312/204 |
| 3,226,776 | A * | 1/1966 | Van Wormer | 49/70 |
| 4,026,588 | A * | 5/1977 | Bisbing et al. | 292/251.5 |
| 4,396,249 | A * | 8/1983 | Aisley | 359/854 |
| 4,703,981 | A * | 11/1987 | Stewart | 312/258 |
| 4,775,231 | A * | 10/1988 | Granzow et al. | 359/860 |
| 4,915,430 | A * | 4/1990 | Vitale | 292/145 |
| 5,163,745 | A * | 11/1992 | Zagata | 312/242 |
| 5,399,008 | A * | 3/1995 | Vann, Jr. | 312/227 |
| D403,907 | S * | 1/1999 | Kato | D6/559 |
| 6,526,694 | B1 * | 3/2003 | Cosgrove | 49/67 |
| 2001/0040423 | A1 * | 11/2001 | Sheehan | 312/245 |
| 2007/0013278 | A1 * | 1/2007 | Herber | 312/227 |
| 2009/0300990 | A1 * | 12/2009 | Marocco | 49/394 |
| 2011/0030294 | A1 * | 2/2011 | Clarson et al. | 52/203 |
| 2011/0031854 | A1 * | 2/2011 | Schwartz | 312/227 |

* cited by examiner

*Primary Examiner* — James O Hansen
*Assistant Examiner* — Kimberley S Wright

(57) ABSTRACT

A cabinet body has a front face in a picture frame configuration with interior and exterior peripheries. The front face has front and rear surfaces. A door frame assembly in a picture frame configuration has interior and exterior peripheries. The exterior periphery is formed with a recess and interior hinges pivotably coupling the door frame assembly to the cabinet body. A mirror is received within the recess and exterior hinges mounted in the recess pivotably coupling the mirror to the door frame assembly.

3 Claims, 2 Drawing Sheets

FIG. 1
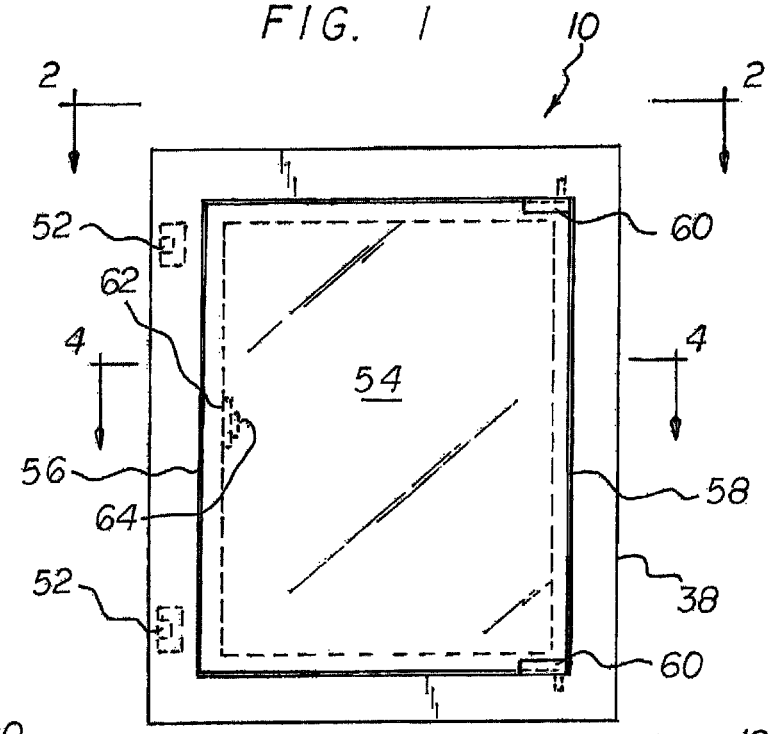
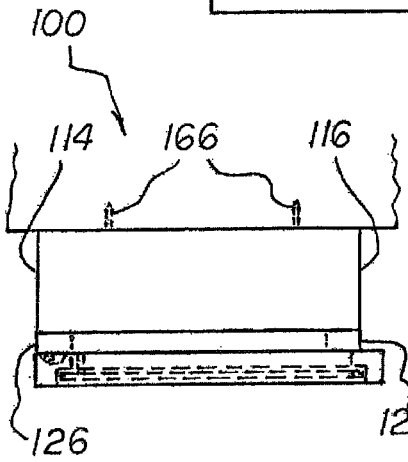
FIG. 3
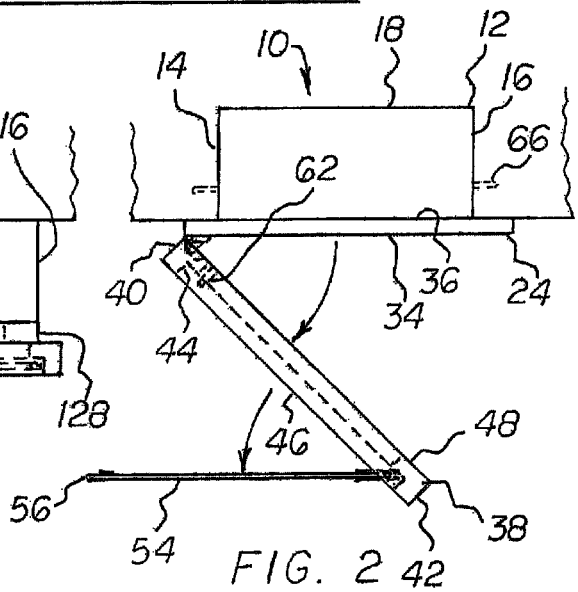
FIG. 2

FIG. 4
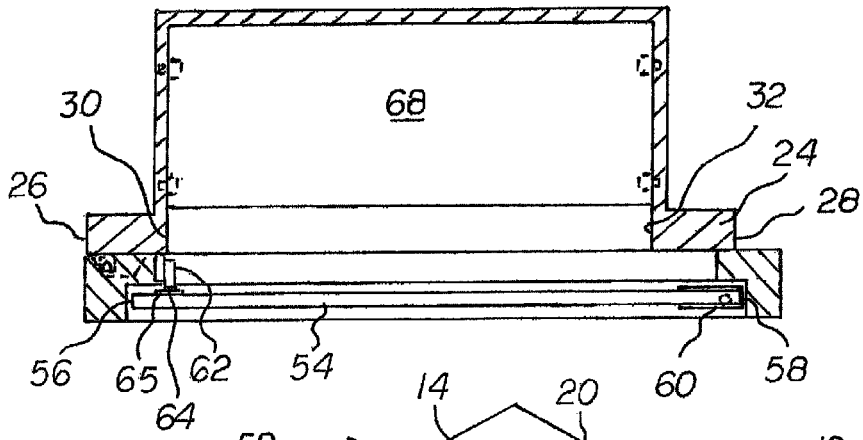
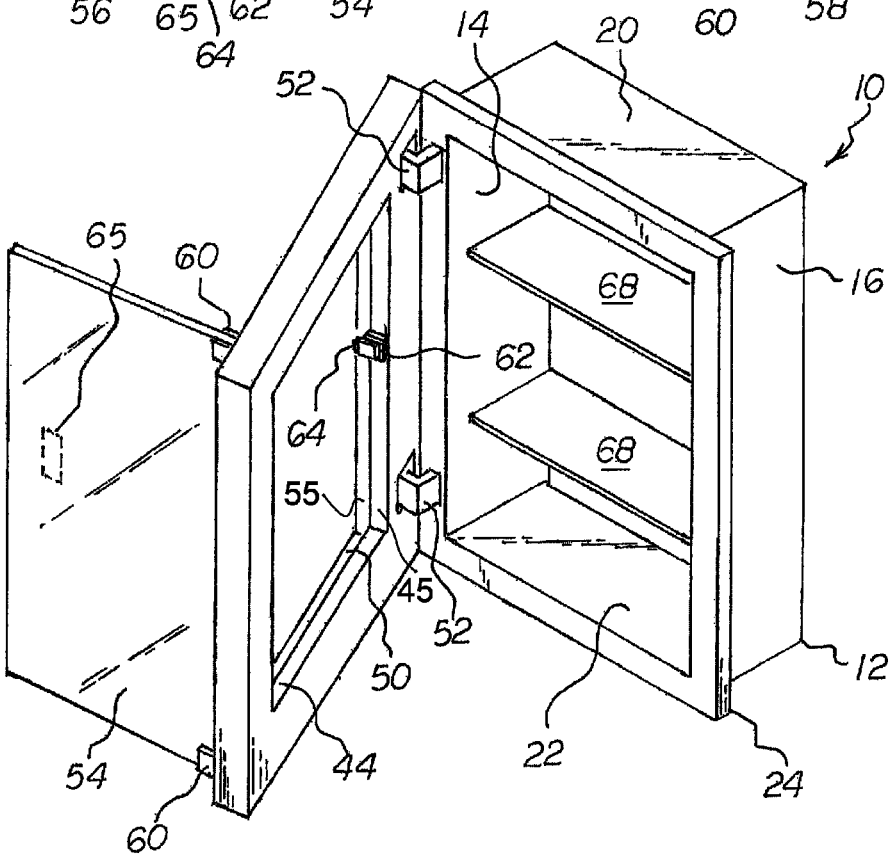
FIG. 5

MEDICINE/COSMETIC CABINET SYSTEM

RELATED APPLICATION

The present application is a continuation-in-part of pending application Ser. No. 12/402,771 filed Aug. 10, 2009, the subject matter of which is incorporated herein by reference.

BACKGROUND OF THE INVENTION

1. Field of the Invention

The present invention relates to a medicine/cosmetic cabinet system and more particularly pertains to selectively opening and closing a medicine/cosmetic cabinet system in any of a plurality of ways and selectively re-positioned the system for viewing one's reflection in any of a plurality of ways.

2. Description of the Prior Art

The use of cabinets and mirrors is known in the prior art. More specifically, cabinets and mirrors previously devised and utilized are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the prior art does not describe a multi-functional, efficient medicine/cosmetic cabinet system that allows selectively opening and closing a medicine/cosmetic cabinet system in any of a plurality of ways and re-positioned the system for selectively viewing one's reflection in any of a plurality of ways.

In this respect, the medicine/cosmetic cabinet system according to the present invention substantially departs from the conventional concepts and designs of the prior art, and in doing so provides an apparatus primarily developed for the purpose of selectively opening and closing a medicine/cosmetic cabinet system in any of a plurality of ways and selectively re-positioned the system for viewing one's reflection in any of a plurality of ways.

Therefore, it can be appreciated that there exists a continuing need for a new and improved medicine/cosmetic cabinet system which can be used for selectively opening and closing a medicine/cosmetic cabinet system in any of a plurality of ways and re-positioned the system for selectively viewing one's reflection in any of a plurality of ways. In this regard, the present invention substantially fulfills this need.

SUMMARY OF THE INVENTION

In view of the foregoing disadvantages inherent in the known types of cabinets and mirrors now present in the prior art, the present invention provides an improved medicine/cosmetic cabinet system. As such, the general purpose of the present invention, which will be described subsequently in greater detail, is to provide a new and improved medicine/cosmetic cabinet system and method which has all the advantages of the prior art and none of the disadvantages.

To attain this, the present invention essentially comprises a medicine/cosmetic cabinet system. The system includes a cabinet body having a front face in a picture frame configuration with interior and exterior peripheries. The front face has front and rear surfaces. Next included is door frame assembly in a picture frame configuration having interior and exterior peripheries. The exterior periphery is formed with a recess and with interior hinges pivotably coupling the door frame assembly to the cabinet body. Also included is a mirror received within the recess and exterior hinges mounted in the recess pivotably coupling the mirror to the door frame assembly.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved medicine/cosmetic cabinet system which has all of the advantages of the prior art cabinets and mirrors and none of the disadvantages.

It is another object of the present invention to provide a new and improved medicine/cosmetic cabinet system which may be easily and efficiently manufactured and marketed.

It is further object of the present invention to provide a new and improved medicine/cosmetic cabinet system which is of durable and reliable constructions.

An even further object of the present invention is to provide a new and improved medicine/cosmetic cabinet system which is susceptible of a low cost of manufacture with regard to both materials and labor and which accordingly is then susceptible of low prices of sale to the consuming public, thereby making such medicine/cosmetic cabinet system economically available to the buying public.

Lastly, it is an object of the present invention to provide a new and improved medicine/cosmetic cabinet system adapted to be selectively opened and closed in any of a plurality of ways and adapted to be selectively re-positioned for viewing one's reflection in any of a plurality of ways, the opening and the closing and the repositioning being done in a safe, convenient an economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a medicine/cosmetic cabinet system constructed in accordance with the principles of the resent invention.

FIG. 2 is a plan view of the medicine/cosmetic cabinet system shown in FIG. 1, the system in an open configuration.

FIG. 3 is a plan view of a medicine/cosmetic cabinet system constructed in accordance with an alternate embodiment of the invention.

FIG. 4 is a cross sectional view taken along line 4-4 of FIG. 1.

FIG. 5 is a perspective view of the system shown in FIGS. 1, 2 and 4.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved medicine/cosmetic cabinet system embodying the principles and concepts of the present invention and generally designated by the reference numeral 10 will be described.

The present invention, the medicine/cosmetic cabinet system 10 is comprised of a plurality of components. Such components in their broadest context include a cabinet body, door frame assembly, mirror, hinges and latch. Such components are individually configured and correlated with respect to each other so as to attain the desired objective.

The present invention is medicine/cosmetic cabinet system 10 adapted to be opened and closed in any of a plurality of ways and adapted to be re-positioned for viewing one's reflection in any of a plurality of ways. The opening and the closing and the repositioning IS done in a safe, convenient an economical manner. The system includes a cabinet body 12 having outer first and second side walls 14, 16, a back wall 18, a top wall 20, and a bottom wall 22, and an open front. The cabinet body is in a rectilinear configuration. The cabinet body also includes a front face 24 in a rectangular picture frame configuration having an exterior periphery in a rectangular configuration with a first exterior side edge 26 and a second exterior side edge 28 separated by an exterior width. The front face has an interior periphery in a rectangular configuration with a first interior edge 30 and a second interior side edge 32 separated by an interior width defining a front face opening coextensive with the open front. The front face has a front surface 34 and a rear surface 36.

Next provided is a door frame assembly 38 in a rectangular picture frame configuration having an exterior periphery in a rectangular configuration with a first exterior side edge 40 and a second exterior side edge 42 separated by an exterior width. The door frame assembly has an interior periphery 44 defining a frame opening. The front face has a front surface 46 and a rear surface 48. The interior periphery is formed with a recess 50 having an exterior recess section (55) and an interior recess section (45). The exterior recess section (55) is contiguous with the front surface and receives the mirror. The interior recess section (45) is contiguous with the rear surface and supports the latch. The exterior recess section (55) is greater in size, both height and width, than the interior recess section (45).

Interior hinges 52 pivotably couple the first side edge of the door frame assembly to the first side edge of the cabinet body. In this manner, the door frame assembly is movable to a closed orientation with the rear face of the door frame assembly in contact with the front face of the cabinet body. In addition, the door frame assembly is movable to an open orientation with the rear face of the door frame assembly spaced from the front face of the cabinet body. The interior hinges resiliently holding the door frame assembly in the closed orientation. The door frame assembly adapted to open outwardly from the cabinet body for entry into the cabinet body.

Next provided is a mirror 54 in a rectangular configuration. The mirror has a first side edge 56 and a second side edge 58. The mirror is of a size for being received within the exterior recess section (55). The mirror is of a size greater than the interior recess section (45).

Exterior hinges 60 are mounted in the exterior recess section (55) adjacent to the second edge of the door frame assembly. The exterior hinges pivotably coupling the second side edge of the mirror to the second side edge of the door frame assembly. In this manner, the mirror is movable to a closed orientation with the mirror totally recessed within the exterior recess section (55). Furthermore, the mirror is movable to an open orientation with the mirror spaced from the door frame assembly. The mirror is adapted to open outwardly from the door frame assembly.

A latch 62 is attached to the first side wall of the door frame assembly. The latch has an outwardly extending finger terminating in a magnet 64 with an associated magnetic plate 65 on the inner surface of the mirror. The finger is movable between a withdrawn position, an extended position and an intermediate position. The finger is adapted to magnetically hold the mirror in the closed orientation when the finger is in the intermediate position. The finger is adapted to release the mirror from the door frame assembly when the mirror and finger are depressed to move the finger to the withdrawn position. The mirror is adapted to pivot from the door frame assembly when the mirror is released and the finger moves to the extended position.

Lastly, shelving 68 is positioned at adjustable heights within the cabinet body for extended utility.

In the primary embodiment of the invention as shown in FIGS. 1, 2, 4 and 5, the system also including fasteners 66 extending through the side walls of cabinet body for coupling in a recess of a wall.

In the alternate embodiment of the invention as shown in FIG. 3, the system also including fasteners 166 extending through the back wall of cabinet body for coupling to a wall. In such alternate embodiment, the first exterior side edge 114 of the cabinet body is co-extensive with the first side edge 126 of the exterior periphery of the door frame assembly. The second exterior side edge 116 of the cabinet body being co-extensive with the second side edge 128 of the exterior periphery of the door frame assembly.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A medicine/cosmetic cabinet system (I0) adapted to be opened and closed in any of a plurality of ways and adapted to be re-positioned for viewing one's reflection in any of a plurality of ways, the opening and the closing and the repositioning being done in a safe, convenient and economical manner, the system comprising, in combination:

a cabinet body (12) including outer first and second side walls (14), (16), a back wall (18), a top wall (20), and a bottom wall (22), and an open front, the cabinet body being in a rectilinear configuration, the cabinet body also including a front face (24) in a rectangular picture frame configuration having an exterior periphery in a rectangular configuration with a first exterior side edge (26) and a second exterior side edge (28) separated by an exterior width, the front face having an interior periphery in a rectangular configuration with a first interior edge (30) and a second interior side edge (32) separated by an interior width defining a front face opening coextensive with the open front, the front face having a front surface (34) and a rear surface (36);

a door frame assembly (38) in a rectangular picture frame configuration having an exterior periphery in a rectangular configuration with a first exterior side edge (40) and a second exterior side edge (42) separated by an exterior width, the door frame assembly having an interior periphery (44) defining a frame opening, the front face having a front surface (46) and a rear surface (48), the interior periphery formed with a recess (50) having an exterior recess section and an interior recess section, the exterior recess section being contiguous with the front surface, the interior recess section being contiguous with the rear surface, the exterior recess section being greater in size, both height and width, than the interior recess section;

interior hinges (52) pivotably coupling the first side edge of the door frame assembly to the first side edge of the cabinet body whereby the door frame assembly is movable to a closed orientation with the rear face of the door frame assembly in contact with the front face of the cabinet body, and whereby the door frame assembly is movable to an open orientation with the rear face of the door frame assembly spaced from the front face of the cabinet body, the interior hinges resiliently holding the door frame assembly in the closed orientation, the door frame assembly adapted to open outwardly from the cabinet body for entry into the cabinet body;

a mirror (54) in a rectangular configuration having a first side edge (56) and a second side edge (58), the mirror being of a size for being received within the exterior recess section, the mirror being of a size greater than the interior recess section;

exterior hinges (60) mounted in the exterior recess section adjacent to the second edge of the door frame assembly, the exterior hinges pivotably coupling the second side edge of the mirror to the second side edge of the door frame assembly whereby the mirror is movable to a closed orientation with the mirror totally recessed within the exterior recess section, and whereby the mirror is movable to an open orientation with the mirror spaced from the door frame assembly, the mirror adapted to open outwardly from the door frame assembly;

a latch (62) attached to the interior recess section, the latch having an outwardly extending finger terminating in a magnet (64) with an associated magnetic plate (65) on the mirror, the finger adapted to magnetically hold the mirror, the finger adapted to release the mirror from the door frame assembly, the mirror adapted to pivot from the door frame assembly;

shelving (68) positioned at adjustable heights within the cabinet body for extended utility.

2. The system as set forth in claim 1 and further including fasteners (66) extending through the side walls of cabinet body for coupling in a recess of a wall.

3. The system (100) as set forth in claim 1 and further including fasteners (166) extending through the back wall of cabinet body for coupling to a wall, the first exterior side edge (114) of the cabinet body being co-extensive with the first side edge (126) of the exterior periphery of the door frame assembly, the second exterior side edge (116) of the cabinet body being co-extensive with the second side edge (128) of the exterior periphery of the door frame assembly.

* * * * *